United States Patent [19]

Petersen

[11] Patent Number: 5,074,220

[45] Date of Patent: Dec. 24, 1991

[54] OVERHEAD MONORAIL TRANSIT SYSTEM EMPLOYING CARRIAGE WITH UPPER GUIDE WHEEL AND GUIDEWAY WITH CONCAVE UPPER SURFACE

[76] Inventor: Stanley Petersen, 130 Clearview Dr., Polson, Mont. 59860

[21] Appl. No.: 390,657

[22] Filed: Aug. 7, 1989

[51] Int. Cl.[5] ..... B61B 3/00

[52] U.S. Cl. ..... 104/93; 104/130; 104/139; 105/150

[58] Field of Search ..... 104/89, 93, 124, 130, 104/139, 140, 304; 105/148, 150; 246/424, 426, 439

[56] References Cited

U.S. PATENT DOCUMENTS

| | | | |
|---|---|---|---|
| 305,060 | 9/1884 | Downing | 104/105 X |
| 1,038,504 | 9/1912 | Smith | 104/139 |
| 2,781,001 | 2/1957 | Davino | 104/89 |
| 3,028,455 | 4/1962 | Devonshire | 104/94 X |
| 3,064,585 | 11/1962 | Ewing, Jr. | 104/93 |
| 3,071,825 | 1/1963 | Ferris | 104/105 X |
| 3,593,666 | 7/1971 | Savage | 104/89 |
| 3,628,462 | 12/1971 | Holt | 104/130 |
| 3,780,666 | 12/1973 | Perott | 104/130 |
| 3,830,163 | 8/1974 | Wright et al. | 104/130 |
| 3,853,068 | 12/1974 | Avery | 104/292 |
| 3,937,147 | 2/1976 | Szent-Miklosy, Jr. | 104/93 |
| 3,987,734 | 10/1976 | Horn | 104/89 |
| 4,144,817 | 3/1979 | Morita | 104/93 |
| 4,171,670 | 10/1979 | Roberts | 104/93 |
| 4,229,857 | 10/1980 | Toder | 104/89 |
| 4,393,786 | 7/1983 | Dull et al. | 104/130 X |
| 4,522,128 | 6/1985 | Anderson | 104/130 |
| 4,554,873 | 11/1985 | Rex | 104/88 |
| 4,671,183 | 6/1987 | Fujitu et al. | 104/93 |
| 4,841,871 | 6/1989 | Liebowitz | 104/139 |

FOREIGN PATENT DOCUMENTS

| | | | |
|---|---|---|---|
| 1340266 | 9/1963 | France | 104/93 |

*Primary Examiner*—Douglas C. Butler
*Assistant Examiner*—S. Joseph Morano
*Attorney, Agent, or Firm*—David Pressman

[57] ABSTRACT

A preferred embodiment of an overhead monorail rapid transit system (10) has a tubular enclosed guideway (12) that is supported above ground level by elevational supports (14). At various locations the guideway splits from a mainline guideway (16) to a secondary guideway (18 and a switching segment (20). The system includes a self-propelled transit vehicle (50) having a carriage or trolley (52) that is mounted within the enclosed guideway with a coupling (54) supporting a depending passenger compartment. The carriage (52) includes a central frame with front and tandem rear whel assemblies and an intermediate stabilizing wheel that engages the upper portion of the inside of the guideway for stabilizing the carriage and passenger compartment to minimize lateral movement. To turn the carriage from the mainline guideway onto the secondary guideway, an actuator (128) is activated to raise guide rollers (124 and 126) elevationally to cause the rollers to engage a side cam surface for deflecting the guide rollers laterally in an opposite direction to pivot the front wheel to turn the carriage onto the secondary guideway.

15 Claims, 6 Drawing Sheets

OVERHEAD MONORAIL TRANSIT SYSTEM EMPLOYING CARRIAGE WITH UPPER GUIDE WHEEL AND GUIDEWAY WITH CONCAVE UPPER SURFACE

BACKGROUND

1. Field of Invention

This invention relates to overhead monorail personal transit systems, particularly to one with greater stability and an improved turning system.

2. Prior Art

Although there has been a general recognition of the need for well constructed, safe, and rapid transit systems to transport people in large as well as intermediate sized cities, the costs have been essentially prohibitive.

Overhead monorail system have been proposed to solve this need, and have been known for many years, but previous designs were deficient in simplicity of operation, lightness of overall weight, economy of manufacture, reliability, and safety of operation.

Examples of previous suggested monorail systems are illustrated in U.S. Pat. Nos. 2,781,001 to Davino (1957); 3,064,585 to Ewing, Jr. (1962); 3,830,163 to Wright et al. (1974); 3,853,068 to Avery (1974); 3,937,147 to Szent-Miklosy (1976);3,987,734 to Horn (1976); 4,171,670 to Roberts (1979); 4,393,786 to Dull et al. (1983); and 4,522,128 to Anderson (1985).

One of the most difficult problems concerns stability of the carriage and the overhead guideway switching mechanisms; the latter are supposed to enable the depending vehicle to turn onto a secondary or side guideway in a safe, reliable manner. It has been noted, particularly in the above Anderson patent, that it is desirable to eliminate any moving parts in the guideway itself. However such designs require additional guide rails at the intersections or diversion locations for guiding the vehicle through a turn.

OBJECTS AND ADVANTAGES

Accordingly one of the principal objects and advantages of the invention is to provide an overhead monorail transit system that has increased stability and no moving parts in its guideway. Other objects are to provide such a system that is simple in operation, light in construction, economical to manufacture and maintain, and above all, reliable and safe in operation.

These and further objects and advantages of this invention will become apparent upon reviewing the following details of a preferred embodiment.

DRAWINGS

FIG. 7 is an isolated view of a trolley of the transit vehicle that moves within a tubular housing of the guideway.

FIG. 9 is an isolated plan view of the trolley similar to FIG. 8 except showning the trolley following the path defined by the secondary guideway as it diverges from the main.

Figure 11:
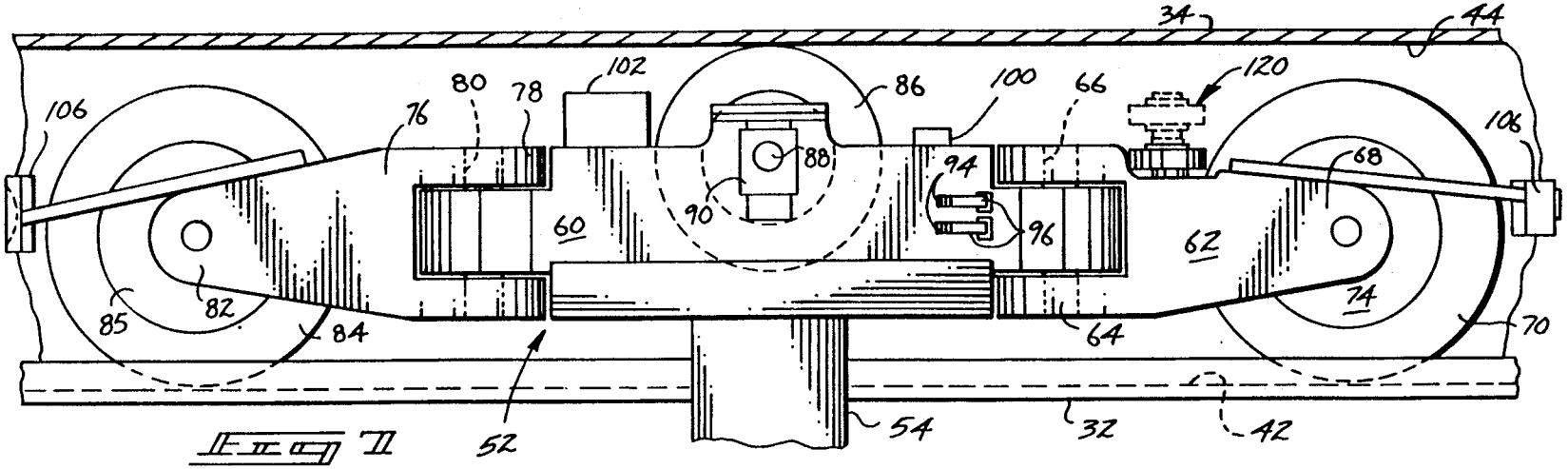
Figure 8:
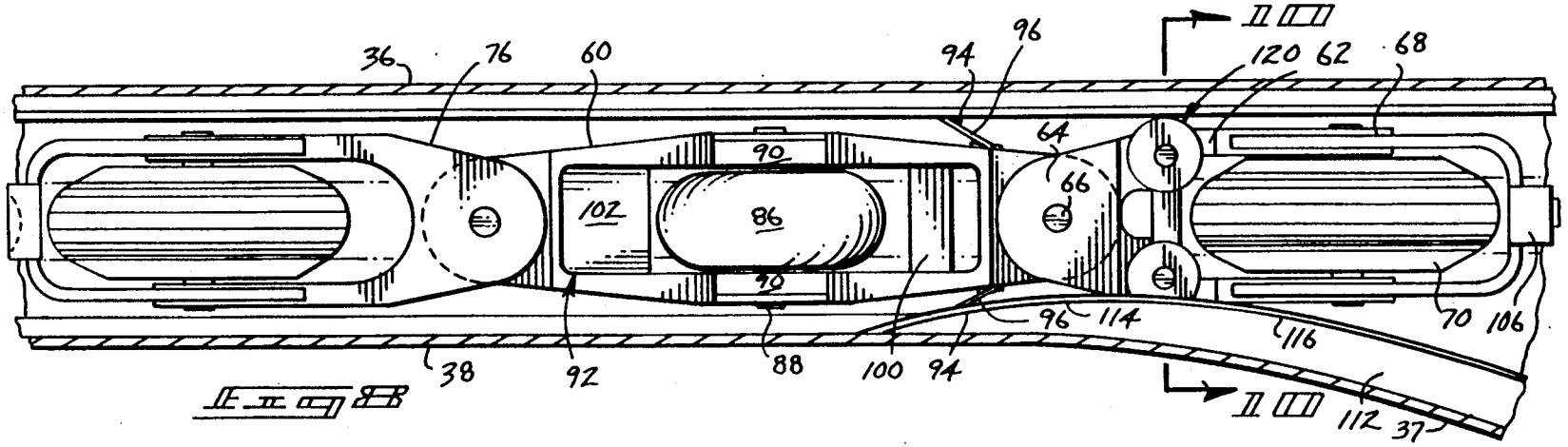
FIG. 8 is an isolated plan view of the trolley of FIG. 7 showing it following the path defined by the main guideway as it extends through an intersection.
Figure 4:
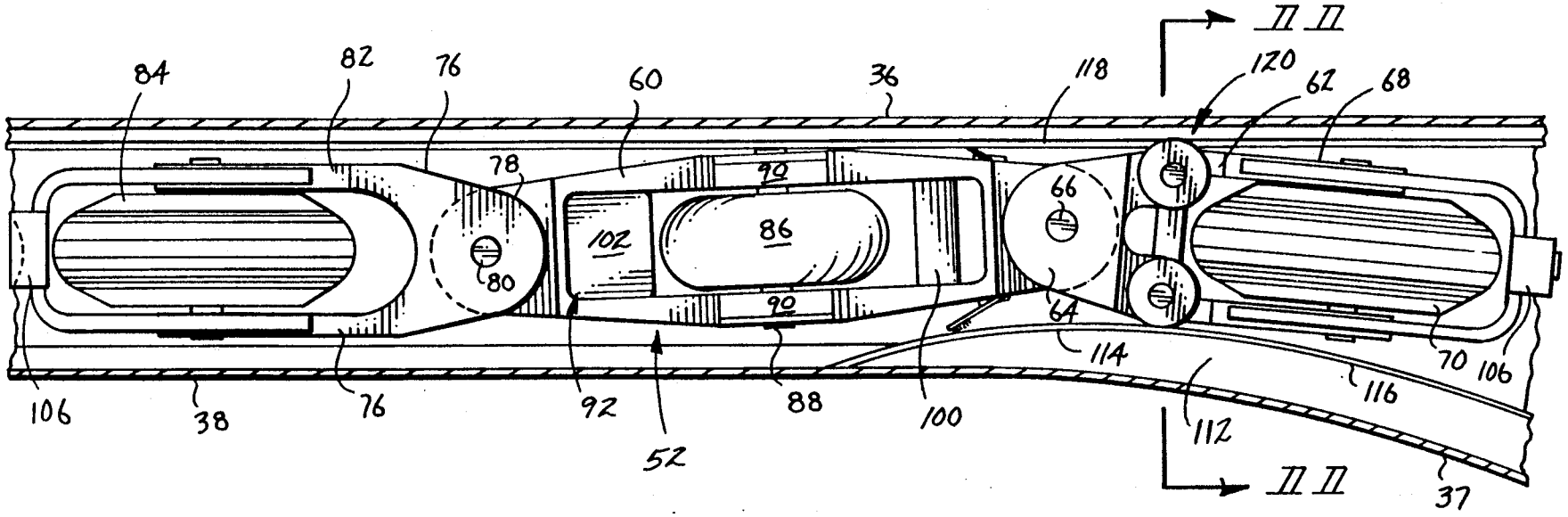
Figure 10:
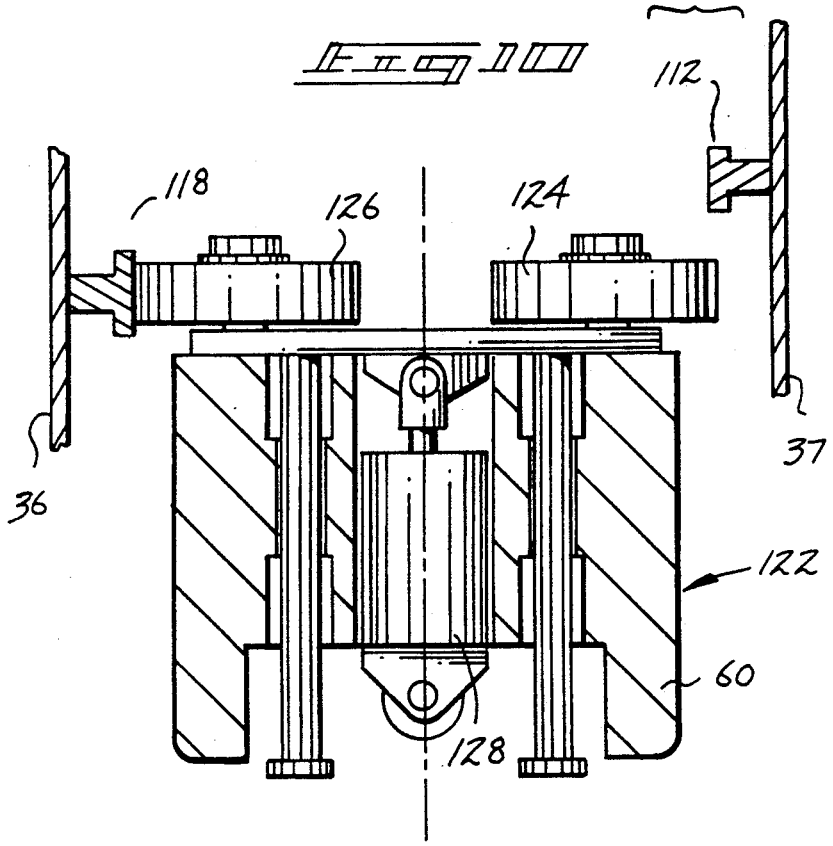
Figure 11:
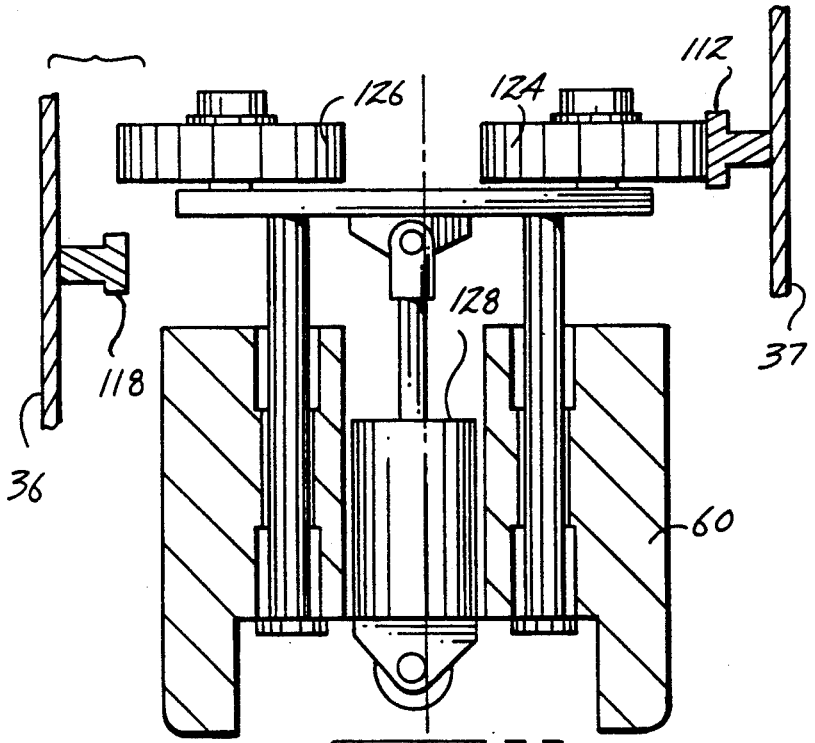

FIG. 10 is a fragmentary vertical cross-sectional view taken along line 10—10 in FIG. 8 illustrating a guide roller assembly for turning a front wheel of trolley in which the assembly is illustrated in position to maintain the trolley on the mainline guideway; and FIG. 11 is a fragmentary vertical cross-sectional view taken along line 11—11 in FIG. 9 showing the guide roller assembly in position to turn the front wheel to divert the trolley to the secondary guideway.

DESCRIPTION

General System

Figure 1:
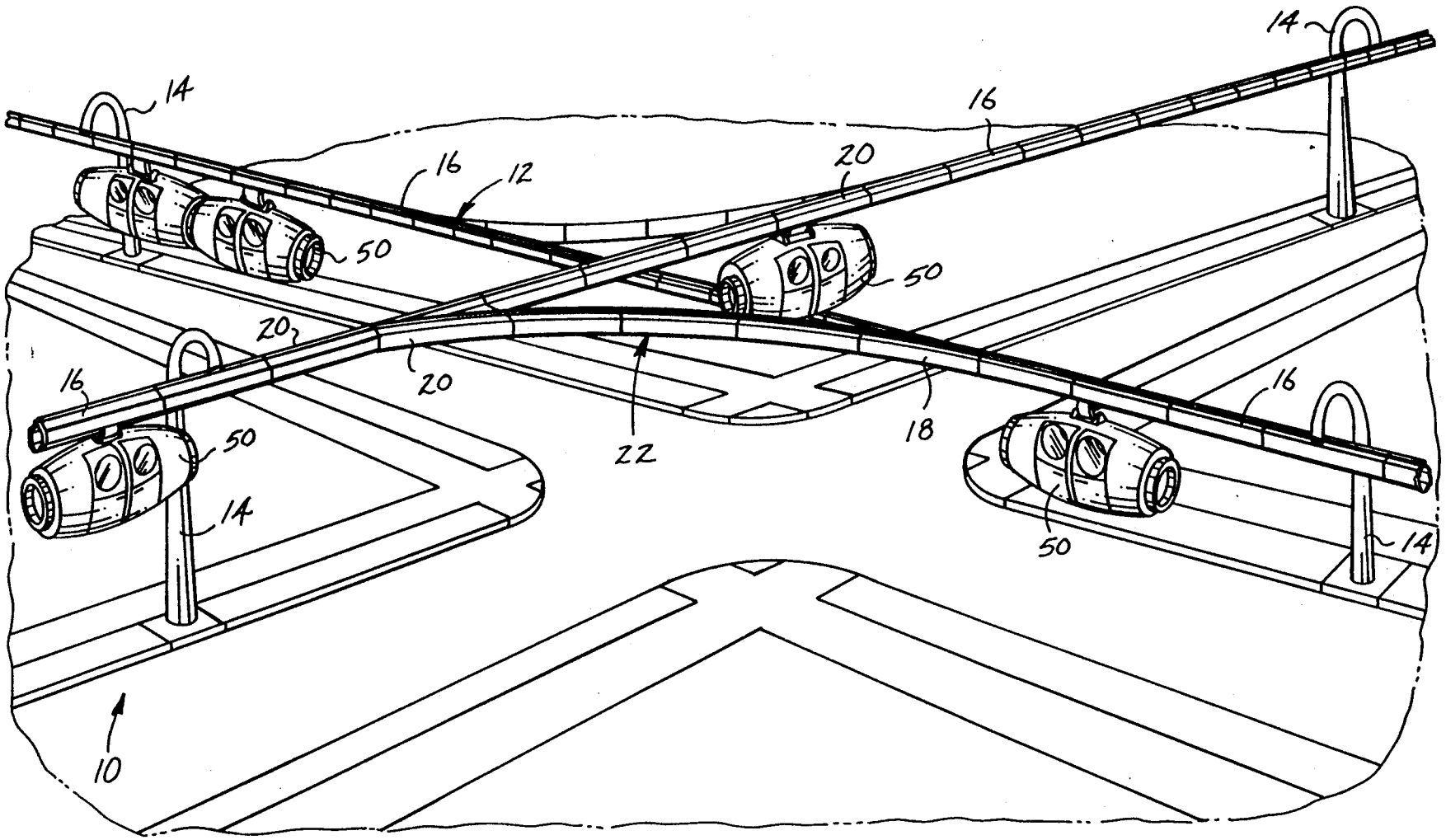
FIG. 1 is an isometric view of a preferred embodiment of an overhead monorail transit system, illustrating an intersection in which a secondary guideway diverges from a mainline guideway.
Figure 2:
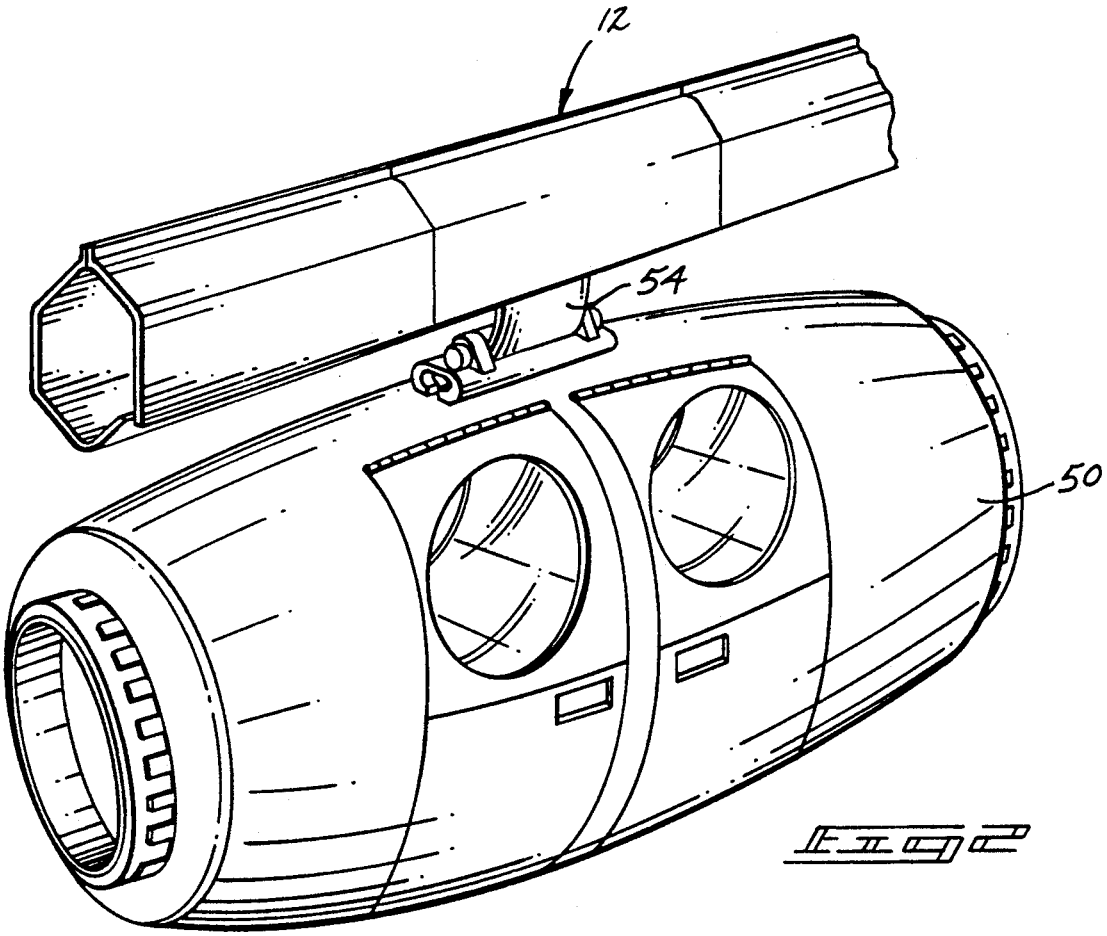
FIG. 2 is an isometric view of a section of the system of FIG. 1 showing a transit vehicle depending from the guideway.
Figure 6:
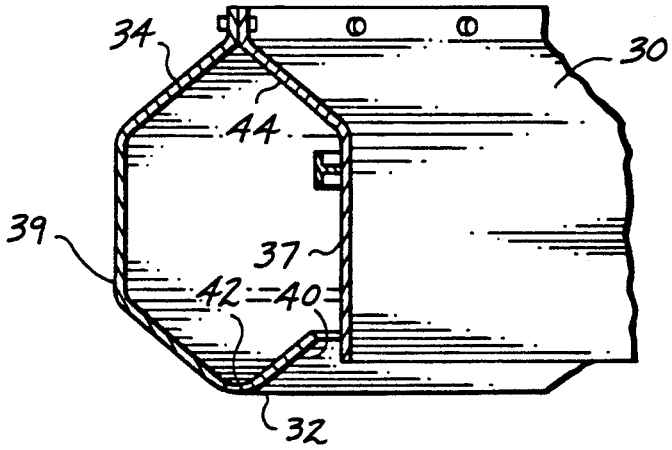
FIG. 6 is a vertical cross-sectional view taken along the line 6—6 in FIG. 3 and illustrating a section of the secondary guideway downstream of the switching section.
Figure 3:
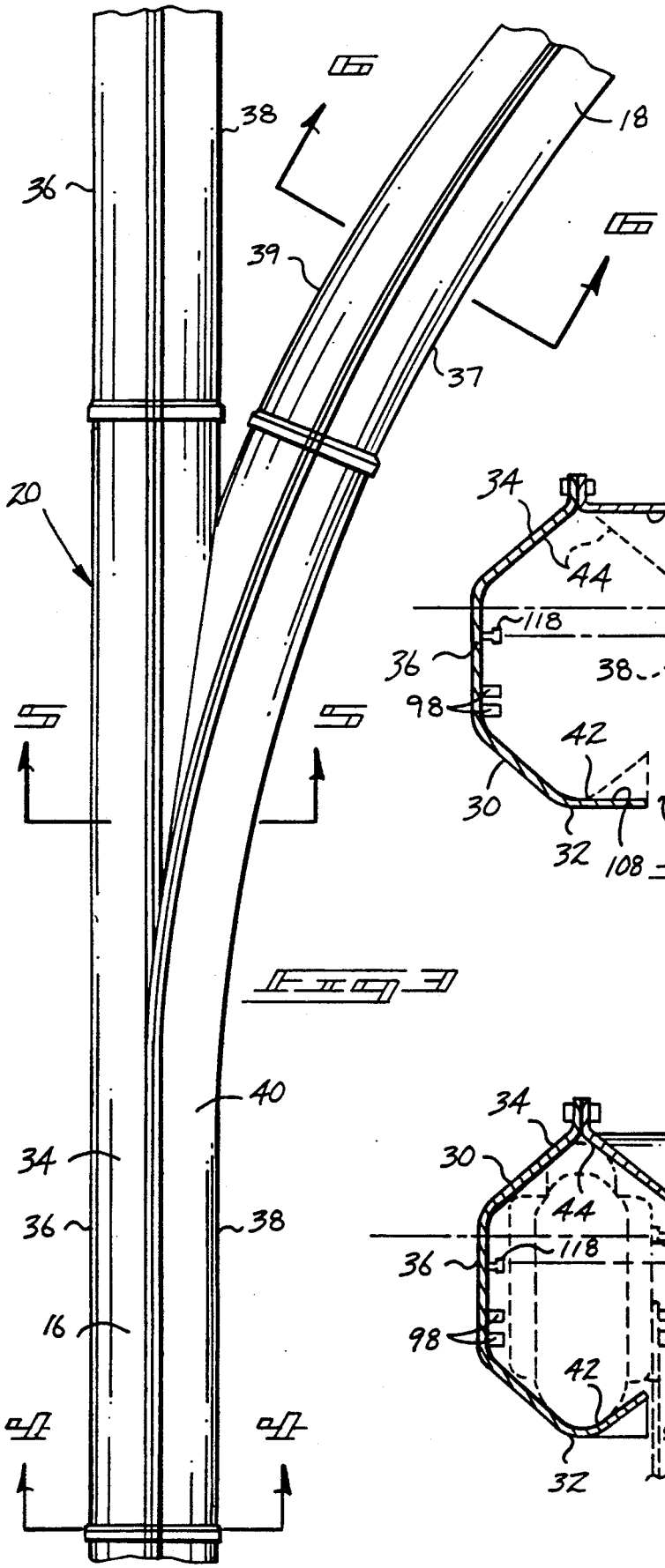
FIG. 3 is a fragmentary plan view of a switching section of the guideway illustrating a secondary guideway diverging from a main guideway.
Figure 5:
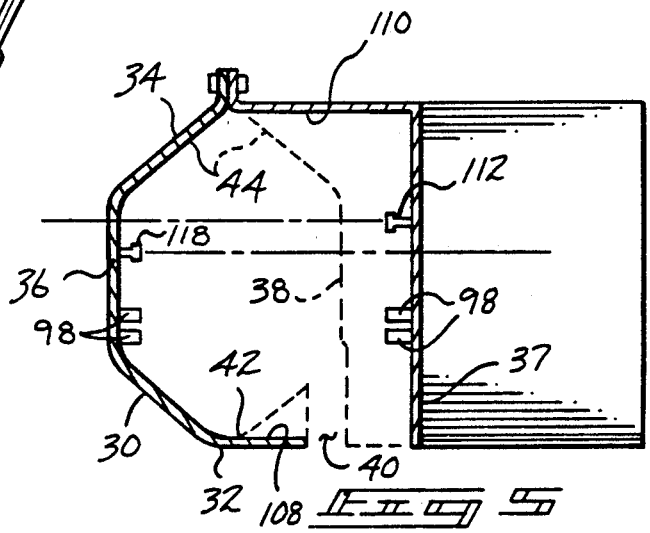
FIG. 5 is a vertical cross-sectional view taken along the line 5—5 in FIG. 3 and illustrating a section of the guideway at a location where the secondary diverges from the main.

An overhead monorail rapid transit system 10 is illustrated in FIG. 1 for transporting passengers or cargo from one location to another. System 10 includes a guideway means 12 that is supported above the train by elevational supports or pillars 14. Supports 14 are spaced at desired intervals along the guideway. Guideway 12 includes a mainline or main guideway 16 which handles the bulk of the traffic. At desired locations, secondary guideways, such as 18, are provided to take the passengers or cargo to alternative destinations. Guideways 16 and 18 intersect in a switching segment 20. Generally segments 20 are located at an intersection 22.

Figure 4:
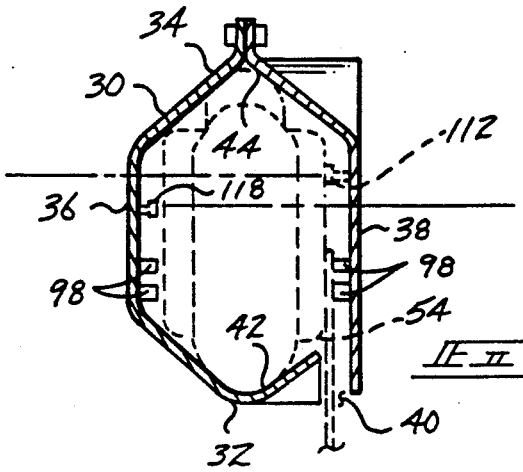
FIG. 4 is a vertical cross-sectional view taken along the line 4—4 in FIG. 3 and illustrating a section of the main guideway upstream of the switching section.

An important aspect of the system is that guideway 12 includes a tubular housing 30 that is substantially enclosed, as illustrated in FIGS. 3–6. Housing 30 preferably is vertically elongated with a major vertical dimension and a minor horizontal dimension, as illustrated in FIG. 4. Housing 30 includes a lower or bottom wall 32, an upper or top wall 34, and side walls 36 and 38 that extend upward from lower bottom wall 32 to upper wall 34. The secondary guideway generally has a rather large radius of curvature with an inner sidewall 37 and an outer sidewall 39 illustrated in plan view in FIG. 3. Preferably housing 30 provides an offset open slot 40 in bottom wall 32. Alternatively the slot can be at the lowest point in the bottom wall. Wall 32 forms a lower track surface 42 that is preferably of a concave shape, as illustrated in FIG. 4. Likewise upper wall 34 is formed with an upper track surface 44 that is likewise concave.

System 10 includes a self-propelled transit vehicle 50 for transporting passengers or cargo along the monorail transit system. Vehicle 50 includes a depending compartment that is supported by a carriage or trolley 52 (FIGS. 7 and 9) that rides in guideway 12. A coupling element 54 (FIG. 7) is attached to carriage 52 and extends downward through slot 40 detachably connecting carriage 52 to the compartment 50. The coupling may have shock absorbing elements to minimize lateral movement of compartment 50.

Carriage

Trolley or carriage 52 includes an elongated central frame 60 (FIGS. 7–9) having a transverse profile for fitting within guideway 12 for supporting coupling 54. Carriage 52 includes a front wheel assembly 62. Assembly 62 has a pivot yoke 64 interconnecting with the central frame through a vertical pivot shaft 66. Assembly 62 includes a wheel fork 68 that extends forward to rotatably receive front wheel 70. Wheel 70 has a convex tread in cross-section (FIG. 8) that is complimentary to lower track surface 42. Assembly 62 includes a conventional electrical motor 74 that is mounted in wheel 70 for driving carriage 52 in the forward direction. The specific structure of motor 74 is not illustrated, as such a motor is conventional.

Carriage 52 also includes a rear wheel assembly 76 that is likewise pivotally attached to frame 60. Assembly 76 includes a pivot yoke 78 similar to pivot yoke 64 for receiving a vertical pivot shaft 80 to enable rear wheel assembly 76 to pivot about a vertical axis defined by shaft 80 to enable assembly 76 to turn laterally with respect to frame 60. Assembly 76 has a fork 82 for rotatably supporting a rear wheel 84. Wheel 84, like front wheel 70, includes a convex tread in the transverse cross-section that is complementary to the profile of lower track surface 42. Assembly 76 includes a conventional electric motor 85 that is mounted in wheel 84 for driving the carriage in a forward direction in cooperation with motor 74.

Carriage 52 further includes a stabilizing wheel 86 that is mounted on frame 60 intermediate wheels 70 and 84. Wheel 86 rotates about a shaft 88 which is mounted in bearing assemblies 90 that are spring loaded to bias stabilizing wheel 86 upward above the central frame. Wheel 86 (best shown in FIGS. 4 and 8) has a convex circumferential outer surface which thus mates with, engages and rides in upper track 44. Track 44, which is a concave upper wall or groove (FIGS. 4 to 6) of guideway 12, thus prevents wheel 86 from lateral movement and thus acts to maintain the carriage upright within guideway 12 to minimize lateral swaying of compartment 50. Wheel 86 is preferably free wheeling, although it may be driven by an electrical motor.

Control Components

Carriage 52 additionally includes a control system for controlling the movement of the carriage within guideway 12. The control system includes an electrical system for supplying electricity to motors 74 and 85. Such a system includes commutator brushes 94 mounted on leaf spring arms 96 that extend outward from the sides of frame 60 for engaging power conductors 98 that extend longitudinally along sidewalls 36 and 38 of guideway 12. The control system includes means for receiving signals from a central control for each individual carriage 52. In the preferred embodiment, system 10 includes a signal transmitter-receiver 100 for sending a receiving digital signals to and from the central control to control the operation of the carriage. Although the control system is not shown in any specific detail, it does include shielded control electronics and control processors 102 for receiving signals from a central location to operate carriage 52.

Additionally, the control system includes a rear receiver-transmitter 107 that may be utilized to transmit signals between adjacent vehicles or to transmit signals from control points. Likewise, control system preferably also includes a front receiver/transmitter 106 for transmitting information from one carriage to another or from a fixed location to a carriage for initiating or changing control information to control electronics 102.

Camming Components

Guideway 12 at each switching segment 20 has flat surfaces 108 and 110 (FIG. 5), rather than concave surfaces 42 and 44. Surfaces 108 and 110 permit front wheel 70 to easily turn from mainline guideway 12 onto secondary guideway 18. Flat surfaces 108 and 110 are specifically illustrated in FIG. 5.

At each switching segment 20, secondary guideway 18 has a roller cam surface 112 (FIGS. 8 and 9) that is positioned along inner sidewall 37 at a first elevation. Surface 112 includes an initial section 114 that projects into the guideway enclosure. Section 114 then extends into a main section 116.

Segment 20 additionally has a roller cam surface 118 (FIGS. 10 and 11) positioned on sidewalls 36 opposite from inner sidewall 37. Surface 118 is positioned at a second elevation vertically spaced from surface 112. Surface 118 extends along the mainline guideway 16 through switching segment 20 to maintain the carriage in guideway 16 if the carriage has not been signalled to turn onto secondary guideway 18. Surface 112 causes carriage 52 to turn onto secondary guideway 18 if the carriage is signalled to turn.

Carriage 52 includes cam follower means 120 (FIGS. 7–9) associated with the cam surfaces 112 and 118 for turning the front wheel assembly in response to a turning signal. Cam follower 120 includes a guide roller assembly 122, illustrated more specifically in FIGS. 10 and 11.

Assembly 122 includes a right guide roller 124 that extends slightly outward from the right side of carriage 52 and a left guide rolller 126 that extends slightly outward from the left side of the carriage. Assembly 122 is preferably mounted on the front wheel assembly 62 adjacent shaft 66 rearward of wheel 70. Rollers 124 and 126 rotate about vertical axes. Rollers 124 and 126 are mounted for vertical movement by an actuator 128. In FIG. 10, the actuator is shown in the retracted position with rollers 124 and 126 in the lower elevation with roller 126 in engagement with cam surface 118 on sidewall 36. In this configuration, cam surface 118 prevents assembly 122 from moving laterally, thereby to prevent the front wheel from turning to maintain the carriage moving in guideway 16 though the switching segment.

Operation

When the carriage receives a signal to turn the vehicle from guideway 16 onto guideway 18, actuator 128 is energized to elevate rollers 124 and 126 to the elevated position so that guide roller 124 engages surface 112. Such engagement causes assembly 122 to be moved laterally as shown in FIGS. 9 and 11 to move the vertical axis of shaft 66 toward wall 36 to in turn cause the front wheel to turn in the opposite direction toward guideway 18. Just a slight lateral movement of assembly 122 causes the front wheel to pivot in the turning position into guideway 18. After the carriage is moved onto guideway 18, the wheels are again received in concave track surfaces 42 and 44. As mentioned, segment 20 may be located at an intersection or at a passenger station to move the vehicle off of the main line onto a secondary guideway. In some circumstances segment 20 may be located at the branch of two main lines as opposed to a secondary guideway. The term "secondary guideway" thus can also include a second main line that is merely a branch of the main guideway.

Details of the system for controlling the speed of motor 74 and actuator 128 are not detailed since such systems are conventional and may be widely varied from one system to another depending upon the size of the system and its sophistication.

Ramifications And Scope

The invention has been described in language more or less specific as to structural features. It is to be understood, however, that the invention is not limited to the specific features shown, since the means and construction herein disclosed comprise only one preferred form of putting the invention into effect. The invention therefore should be determined in accordance with the appended claims appropriately interpreted in accordance with the doctrine of equivalents.

I claim:

1. An overhead monorail rapid transit system, comprising:

an overhead monorail guideway including a switching segment having a first guideway section and a second guideway section which diverges from said first guideway section; said guideway comprising an enclosed tubular housing with a lower surface, an upper surface, and side surfaces extending upward from said lower surface to said upper surface, and a transit vehicle having (1) a carriage movably mounted on said guideway within said enclosed tubular housing, and (2) a compartment detachably depending from said carriage below said guideway, said carriage having (a) a carriage frame, (b) a front wheel assembly mounted to said frame and including a front wheel engaging said lower surface of said tubular housing, (c) a rear wheel assembly mounted to said frame in tandem with said front wheel assembly and including a rear wheel engaging said lower surface of said tubular housing, (d) a stabilizing wheel rotatably mounted on an upper portion of said frame in a position so that it engages said upper surface of said tubular housing so as to maintain said carriage upright and to minimize lateral movement of said compartment, said stabilizing wheel being mounted in said frame in a position intermediate said front and said rear wheel assemblies, (e) drive means operatively connected to propel said vehicle along said monorail guideway, (f) said front wheel assembly being pivotally mounted to said carriage frame for turning movement about a first vertical pivot axis rearward of said front wheel to enable said carriage to turn from said first guideway section onto said second guideway, section (g) said carriage having a pair of side cam rollers mounted rearward of said turnable front wheel for rotation about substantially vertical pivot axes for laterally moving said first vertical pivot axis to turn said front wheel about said first vertical pivot axis, (h) actuator means operatively connected to said side cam rollers for elevating said side cam rollers between a first predetermined elevation and a second predetermined elevation, (i) said second guideway section having a roller engaging cam surface along a side surface thereof at said second predetermined elevation and projecting into a path of one of said side cam rollers for engagement by one of said side cam rollers to move said first vertical pivot axis laterally away from said cam surface, thereby to turn said front wheel assembly about said first vertical pivot axis in the direction of said second guideway section to steer said vehicle onto said second guideway section when said side cam rollers are at said second predetermined elevation.

2. The overhead monorail rapid transit system of claim 1 wherein each of said front and rear wheels has a convex tread and wherein said lower surface of said guideway, except at said switching segment, has a concave contour in cross-section to conformingly mate with said convex treads of said front and rear wheels.

3. The overhead monorail rapid transit system of claim 1 wherein said tubular guideway has an oblong cross-section with a major dimension in a vertical direction and a minor dimension in a horizontal direction.

4. The overhead monorail rapid transit system of claim 3 wherein both said lower and upper surfaces are contoured to receive said wheels and maintain said carriage upright.

5. The overhead monorail rapid transit system of claim 1 wherein said upper surface of said guideway has a concave contoured track formed therein for receiving said stabilizing wheel so as to maintain said carriage in an upright orientation within said tubular guideway.

6. The overhead monorail rapid transit system of claim 1 wherein said second guideway section has an inner sidewall and an outer sidewall and wherein said roller cam surface is mounted to said inner sidewall at said second predetermined elevation to project into said path of said one side cam roller when said one side cam roller is in said second predetermined elevation so as to turn said front wheel about said first vertical pivot axis and direct said front wheel and said carriage onto said second guideway section.

7. The overhead monorail rapid transit system of claim 1 wherein said first guideway section comprises a cam surface positioned at said first predetermined elevation for engaging the other of said side cam rollers to prevent lateral movement of said first vertical pivot axis when said side cam rollers are at said first predetermined elevation to prevent said carriage from turning onto said second guideway section.

8. The overhead monorail rapid transit system of claim 1 wherein said lower surface of said guideway is concave, except at said switching segment where it is substantially flat.

9. The overhead monorail rapid transit system of claim 1 wherein said tubular housing is substantially elliptical in cross-section with said upper surfacing having a convex contour to receive said stabilizing wheel and with said lower surface being contoured to receive both said front and rear wheels.

10. The overhead monorail rapid transit system of claim 1, further including a coupling for detachably connecting said carriage to said compartment, said coupling having shock absorbing elements to minimize lateral movement of said compartment.

11. An overhead monorail rapid transit system, comprising:

an overhead monorail guideway including a switching segment having a first guideway section and a second guideway section which diverges from said first guideway section; said guideway comprising an enclosed tubular housing with an elongated interior, a lower side, an upper side having a inner surface facing said interior, said inner surface being concave when seen from said interior so as to provide a concave inner surface, and side walls extending upward from said lower side to said upper side, and a transit vehicle having (1) a carriage movably mounted on said guideway within said enclosed tubular housing, and (2) a compartment detachably depending from said carriage below said guideway, said carriage having (a) a carriage frame, (b) a front wheel assembly mounted to said frame and including a front wheel engaging said lower side of said tubular guideway, (c) a rear wheel assembly mounted to said frame in tandem with said front wheel assembly and including a rear wheel engaging said lower side of said tubular housing, (d) a stabilizing wheel rotatably mounted on an upper portion of said frame in a position so that it engages said upper surface of said tubular housing so as to maintain said carriage upright and to minimize lateral movement of said compartment, said stabilizing wheel being mounted in said frame in a position intermediate said front and said rear wheel assemblies, (e) drive means for propelling said transit vehicle along said monorail guideway, (f) said front wheel assembly being pivotally mounted to said carriage frame for turning movement about a vertical turning axis rearward of said front wheel to enable said carriage to turn from said first guideway section onto said second guideway, section (g) said carriage having a pair of side cam rollers mounted rearward of said front wheel assembly for rotation about substantially vertical pivot axes for laterally moving said turning axis to turn said front wheel about said turning axis, (h) actuator means operatively connected to said side cam rollers for elevating said side cam rollers between a first predetermined elevation and a second predetermined elevation, (i) said second guideway section having a roller engaging cam surface along a side surface thereof at said second predetermined elevation and projecting into a path of one of said side cam rollers for engagement by said one of said side cam rollers to move said turning axis laterally away from said ramp surface to thereby turn said front wheel assembly about said turning axis in the direction of said second guideway section to steer said vehicle onto said second guideway section when said side cam rollers are at said second predetermined elevation, (j) said first guideway section comprising a cam surface positioned at said first predetermined elevation for engaging the other of said side cam rollers to prevent lateral movement of said turning axis when said side cam rollers are at said first predetermined elevation so as to prevent, said carriage from turning onto said second guideway section.

12. The overhead monorail rapid transit system of claim 11, further including a coupling for detachably connecting said carriage to said compartment, said coupling having shock absorbing elements to minimize lateral movement of said compartment.

13. An overhead monorail rapid transit system, comprising:

an overhead monorail guideway comprising an enclosed tubular housing with a lower surface, a concave upper inner surface, and side surfaces extending upward from said lower surface to said concave upper inner surface, and a transit vehicle having (1) a carriage movably mounted on said guideway within said enclosed tubular housing, and (2) a compartment depending from said carriage below said guideway said carriage having (a) a carriage frame, (b) a front wheel assembly mounted to said frame and including a front wheel engaging said lower surface of said tubular housing, (c) a rear wheel assembly mounted to said frame in tandem with said front wheel assembly and including a rear wheel engaging said lower surface of said tubular housing, (d) a stabilizing wheel having a convex outer circumferential surface, (e) means for rotatably mounting said stabilizing wheel in an upper portion of said frame in a position intermediate said front and said rear wheel assemblies so that said convex outer circumferential surface of said stabilizing wheel engages and mates with said concave upper inner surface of said tubular housing such that said concave inner surface of said tubular housing prevents lateral movement of said stabilizing wheel so as to maintain said carriage upright, and stabilize and minimize lateral movement of said compartment, and (f) drive means for propelling said transit vehicle along said monorail guideway.

14. The overhead monorail rapid transit system of claim 13 wherein said means for rotatably mounting is arranged to spring bias said stabilizing wheel upward.

15. The overhead monorail rapid transit system of claim 13, further including a coupling for detachably connecting said carriage to said compartment, said coupling having shock absorbing elements to minimize lateral movement of said compartment.

* * * * *

UNITED STATES PATENT AND TRADEMARK OFFICE

CERTIFICATE OF CORRECTION

PATENT NO. : 5,074,220

DATED : Dec. 24, 1991

INVENTOR(S) : Stanley Petersen

It is certified that error appears in the above-identified patent and that said Letters Patent is hereby corrected as shown below:

Col. 2, line 68, delete "50".

Col. 5, line 62, change ", section" to --section,--.

Signed and Sealed this

Fourth Day of May, 1993

*Attest:*

Michael K. Kirk

MICHAEL K. KIRK

*Attesting Officer*

*Acting Commissioner of Patents and Trademarks*